US005524533A

United States Patent [19]

Koenig

[11] Patent Number: 5,524,533

[45] Date of Patent: Jun. 11, 1996

[54] APPARATUS FOR CRUSHING AND RELEASING ARTICLES

[76] Inventor: Richard M. Koenig, 604 E. Lakeview Dr., Whitefish Bay, Wis. 53217

[21] Appl. No.: 450,636

[22] Filed: May 25, 1995

[51] Int. Cl.[6] ..... B30B 9/32

[52] U.S. Cl. ..... 100/45; 100/53; 100/137; 100/215; 100/218; 100/902

[58] Field of Search ..... 100/45, 53, 137, 100/215, 218, 902

[56] References Cited

U.S. PATENT DOCUMENTS

| | | | |
|---|---|---|---|
| 2,522,800 | 9/1950 | Quiroz | 100/50 |
| 3,817,169 | 6/1974 | Bischoff | 100/100 |
| 3,857,334 | 12/1974 | Arp | 100/53 |
| 4,213,384 | 7/1980 | Telling | 100/74 |
| 4,216,713 | 8/1980 | Jung | 100/209 |
| 4,291,618 | 9/1981 | Heiser et al. | 100/35 |
| 4,324,325 | 4/1982 | Dewoolfson | 100/902 |
| 4,436,026 | 3/1984 | Imamura et al. | 100/45 |
| 4,469,212 | 9/1984 | DeWoolfson et al. | 100/53 |
| 4,489,649 | 12/1984 | Daugherty | 100/215 |
| 4,821,969 | 4/1989 | Fox et al. | 241/99 |
| 4,953,682 | 9/1990 | Helbawi | 194/208 |
| 5,010,810 | 4/1991 | DeLorme | 100/49 |
| 5,103,721 | 4/1992 | Chou et al. | 100/37 |
| 5,111,927 | 5/1992 | Schulze, Jr. | 194/209 |
| 5,121,685 | 6/1992 | Turner | 100/49 |
| 5,251,546 | 10/1993 | Wergeland et al. | 100/53 |

*Primary Examiner*—Stephen F. Gerrity
*Attorney, Agent, or Firm*—Andrus, Sceales, Starke & Sawall

[57] ABSTRACT

An apparatus for crushing and releasing articles such as metal cans. A fixed anvil is mounted on the frame and a ram is mounted for movement in a direction toward and away from the anvil to crush an article located therebetween. The articles are fed sequentially to the crushing zone between the anvil and ram through a vertical chute. A spring loaded wedge plate extends outwardly from the ram towards the anvil and initially contacts the article intermediate its length to bend or deform the article to thereby insure uniform crushing of the article by the ram. A coil spring is mounted on the frame and has an adjustable finger which projects downwardly into the crushing zone to guide incoming cans fed from the chute into the crushing zone, and to facilitate release of the crushed can in the crushing zone.

16 Claims, 2 Drawing Sheets

FIG. 1
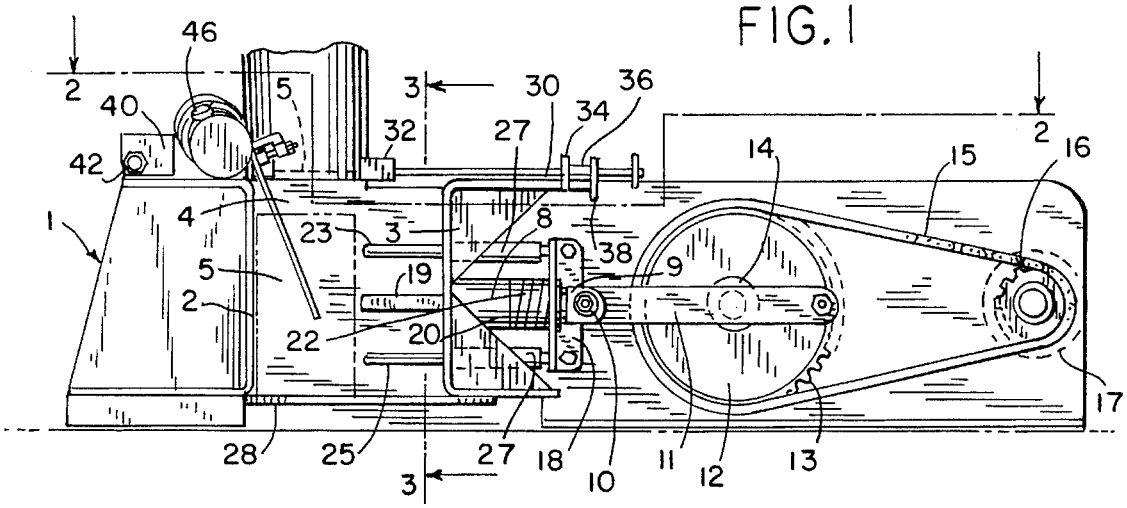
FIG. 2
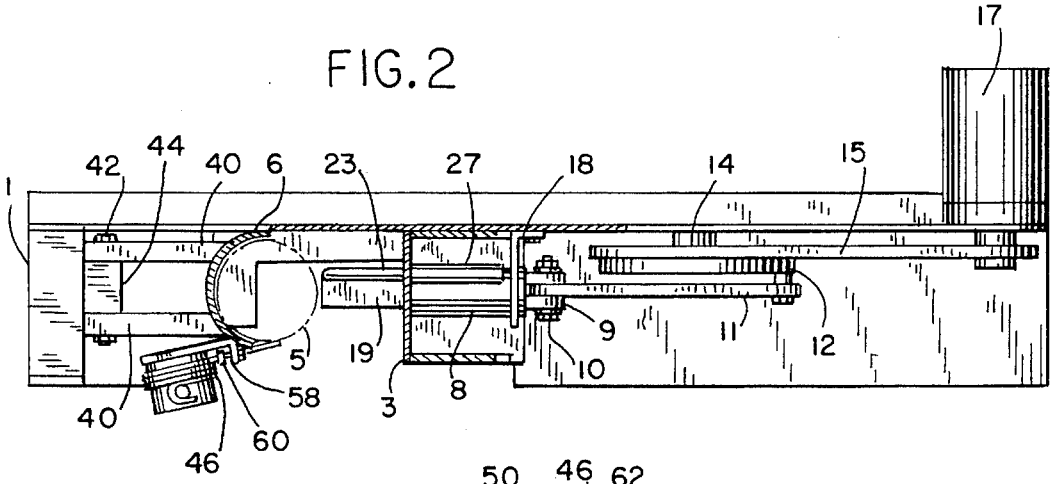
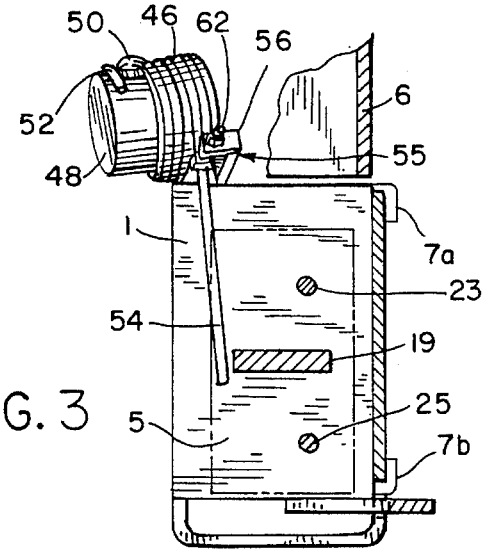
FIG. 3

APPARATUS FOR CRUSHING AND RELEASING ARTICLES

BACKGROUND OF THE INVENTION

In recent years there has been an increased emphasis on energy and material conservation and, as a result, the crushing and recycling of aluminum beverage containers has become an important factor in the recycling effort. In order to recycle used beverage cans, it has been the practice to initially crush or compact the cans to reduce the volume and reduce transportation charges.

Many types of devices have been used in the past for crushing aluminum beverage cans. Small, manually operated crushers have been used by homeowners, in which the cans are individually crushed through operation of a manual handle or lever. For establishments that generate a large number of cans, such as restaurants, bars, and the like, power-operated can crushing devices have been utilized.

One such power-operated can crushing device is disclosed in U.S. Pat. No. 5,327,822 issued Jul. 12, 1994 to Richard M. Koenig, the applicant of this patent application. In the Koenig patent, a fixed anvil is mounted on a frame and a ram is mounted for movement in a direction toward and away from the anvil to crush an article located therebetween. The articles are fed sequentially to the crushing zone between the anvil and the ram through a vertical chute. A spring loaded wedge plate extends outwardly from the ram toward the anvil and initially contacts the article intermediate its length to bend or deform the article to thereby insure uniform crushing of the article by the ram. A series of fixed ejector pins are mounted on the frame and project into the crushing zone. As the ram moves in its return stroke, the crushed can, if hanging up on the ram, will engage the ejector pins to strip the can from the ram and permit the crushed can to fall downwardly into a suitable disposal container.

Although the overall design of the aforedescribed can crushing device has been generally satisfactory, there are several problems which can affect the continuous operation of the device. The first problem deals with the consistent, proper placement of various sized cans in the crushing zone as the cans are sequentially fed from the chute. A second problem relates to the occasional hanging up of the crushed can on the ejector pins as the ram is retracted. A third problem resides in the retarded movement of the ram on the ejector pins during the return stroke of the ram. While all of these problems can be rectified, it is necessary to stop the device and trouble shoot the particular problem before resuming crushing operations. As a result of such down time, operating efficiency is impaired and high volume, uniform crushing is reduced accordingly.

As a result of such drawbacks, it is desirable to provide an improved device for crushing and releasing articles such as metal cans, plastic bottles, and the like. There continues to be a need for an inexpensive, compact, automatic can crusher which can be continuously operated with a minimum of maintenance in establishments that handle a considerable quantity of beverage cans, such as restaurants, bars, fast food eateries, and the like.

SUMMARY OF THE INVENTION

This invention is advantageously directed to an improved apparatus for crushing and releasing articles and has a particular application for crushing metal beverage cans, such as beer or soft drink cans.

In accordance with the invention, a fixed anvil or support is secured to a frame, and the ram is mounted for movement toward and away from the anvil to thereby crush an article located in the crushing zone between the anvil and the ram.

A train or series of end-to-end cans are fed sequentially to the crushing zone through a vertical chute, and a movable stop is located at the bottom of the chute and is disposed to support the lowermost can in the train while a previously fed can is being crushed in the crushing zone. The can being crushed is supported in the crushing zone by a movable support plate.

Both the stop and the support plate are operably connected to the ram so that as the ram is moved toward the anvil and the crushing stroke, the stop will be moved to the supporting position in the chute and the support plate will similarly be moved to a supporting position in the crushing zone to support the can being crushed. As the ram is moved away from the anvil in the return stroke, the support plate will move to a non-obstructing position to enable the crushed can to fall from the crushing zone, and simultaneously the stop will also move to a non-obstructing position to permit the can that was being supported on the stop to fall from the chute to the crushing zone.

A spring loaded wedge plate extends outwardly from the ram in a direction towards the anvil. As the ram moves in the crushing stroke, the wedge plate will initially engage the can at a location generally midway between its ends to thereby bend or deform the can. As the ram completes its crushing stroke, the wedge plate will move inwardly against the force of the spring and the deformed can will be uniformly compacted or crushed.

A pair of fixed ejector pins are strategically mounted on the frame and project into the crushing zone. As the ram moves in its return stroke, the crushed can, if hanging up on the ram, will engage the ejector pins to strip the can from the ram and permit the crushed can to fall downwardly into a suitable disposal container.

As a feature of the invention, a coil spring is mounted on the frame and has an adjustable finger which projects downwardly into the crushing zone to guide incoming cans from the chute into the crushing zone and to facilitate release of the crushed can in the crushing zone.

The apparatus of the invention provides more uniform and continuous crushing or compaction of the cans or other articles. The ram moves transversely towards the axis of the can and the spring loaded wedge plate initially bends the can to provide uniform crushing.

The apparatus is capable of handling cans or articles of various lengths and diameters. It is contemplated that the apparatus can also be used to crush plastic and glass bottles, or other articles, in addition to metal cans.

BRIEF DESCRIPTION OF THE DRAWINGS

The invention will become better understood by reference to the following detailed description of the preferred exemplary embodiment when read in conjunction with the appended drawing wherein like numerals denote like elements; and FIG. 1 is a front elevation of the can crushing apparatus of the invention showing the ram in the retracted position;

FIG. 2 is a combined top and partial sectional view taken on line 2—2 of FIG. 1;

FIG. 3 is a sectional view taken on line 3—3 of FIG. 1;

DETAILED DESCRIPTION OF THE PREFERRED EMBODIMENT

Figure 4:
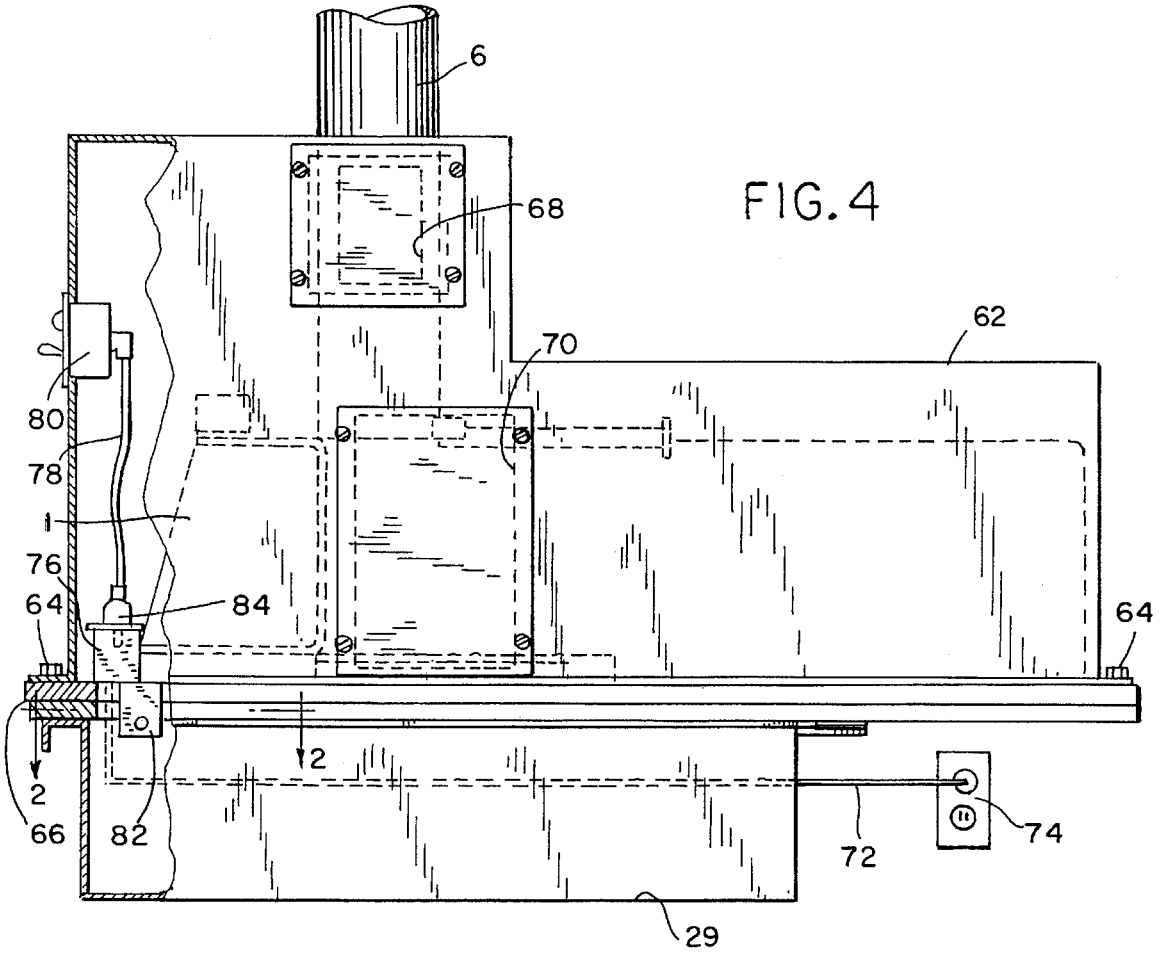
FIG. 4 is a front elevational view of the can crushing apparatus with a guard in place.
Figure 5:
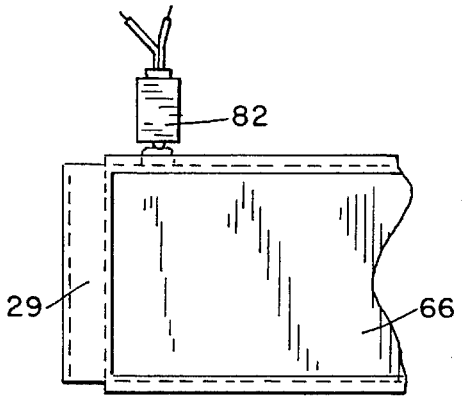
FIG. 5 is a sectional view taken on line 2—2 of FIG. 4.

The drawings illustrate an apparatus for crushing articles such as metal cans, bottles, or the like. The apparatus includes a frame 1 which takes the form of a vertical plate and a channel-shaped anvil 2 is secured to one surface of the plate 1.

Mounted for movement on plate 1 in a direction toward and away from anvil 2 is a channel-shaped ram 3 and the space between anvil 2 and the ram 3 defines a crushing zone 4. A can 5 or article to be crushed is fed to the crushing zone 4 through a generally vertical, tubular chute 6.

To guide the ram 3 in movement toward and away from anvil 2, channel-shaped guide brackets 7*a* and 7*b* are secured to the upper and lower edges of the ram and ride on the upper and lower edges, respectively, of plate 1 as shown in FIG. 3.

Mounted on the rear surface of ram 3 is a cylinder 8 and the closure end of the cylinder carries a pair of lugs 9 which are pivotally connected by pin 10 to the end of the crankarm or connecting rod 11. The opposite end of crankarm 11 is pivotally connected to the peripheral edge portion of a wheel 12 joined to a sprocket 13 mounted for rotation on a shaft 14 projecting outwardly from plate 1. Sprocket 13 is driven via an endless belt chain drive 14 which is entrained about sprocket 13 and a gear 15 driven by a motor 16. Operation of motor 16 through gear 15, chain drive 14, sprocket 13 and wheel 12 acting through connecting rod 11 will move ram 3 in an inward crushing stroke and an outer return stroke.

As best seen in FIGS. 1 and 2, an L-shaped bracket 18 is secured to the plate 1 and is provided with a central opening which receives the connecting rod 11.

Extending outwardly from ram 3 towards anvil 2 is a spring loaded wedge plate 19. The inner end of plate 19 is secured to plunger 20 which is mounted for sliding movement within the cylinder 8. Wedge plate 19 is biased outwardly away from ram 3 by a compression spring 22 which is located within cylinder 8 and is interposed between the end of the cylinder and plunger 20.

The cans 5 are sequentially fed to crushing zone 4 through vertical chute 6 so that the axis of the can in the crushing zone 4 extends vertically as shown in FIG. 1. As ram 3 moves toward anvil 2 in the crushing stroke, the spring loaded wedge plate 19 will initially engage the can approximately midway between the can ends to thereby bend or deform the can and draw the can ends inwardly. Continued movement of the ram in the crushing stroke will then force the wedge plate inwardly against the force of spring 22 and the ram will crush the can against the fixed anvil 2.

To aid in stripping the crushed can 5 from the ram 3, a pair of ejector pins 23 and 25 are mounted in fixed relation in the crushing zone 4. The inner ends of pins 23 and 25 are connected to the bracket 18 and the pins are mounted for sliding movement in sleeves 27 which are secured to the rear face of ram 3. As the ram moves in the return stroke, in a direction away from anvil 2, the crushed can 5, if it adheres to the face of the ram, will be stripped from the ram by the pins 23 and 25. As shown in FIGS. 2 and 3, the pins are positioned above and below wedge plate 19 and are strategically located to strip different sized cans from the ram 3 with a minimum of hang-up and insure that the stripped cans can fall downwardly to a collection site beneath the crushing zone 4.

The can 5 being crushed in the crushing zone 4 is supported on the support plate 28 which moves with the ram 3. Support plate 28 is positioned such that it will support a can in the crushing zone, as the can is fed from the chute and as the ram moves inwardly in the crushing stroke. As the ram moves in the return stroke, support plate 28 will be correspondingly moved to a non-obstructing position where the crushed can 5 can fall by gravity from the crushing zone 4 to a receptacle 29 located beneath the crushing zone.

Cans 5 are in an end-to-end relation or trained within the chute 6. A stop is positioned at the lower end of chute 6 and serves to prevent the can 5 in the chute from falling downwardly into the crushing zone 4. The stop takes the form of a reciprocating rod 30 which is mounted for sliding movement within a block 32 attached to the outer surface of chute 6. In its holding or obstructing position, as seen in FIG. 1, the inner end of rod 30 projects into the lower end of chute 6.

The rod 30 is operably connected to ram 3 and in this regard, a disk 34 is secured to the midpoint of the length of the rod and has a diameter such that the lower edge of the disk will be engaged by the upper edge of the ram as the ram moves in the return stroke. A spring 36 is interposed between disk 34 and the fixed bracket 38 which is mounted on plate 1.

With this construction, movement of ram 3 in the return stroke will cause the rear edge of the ram to engage disk 34, thereby retracting the rod 30 from chute 6 against the force of spring 36 to enable the can 6 being held in the lower end of the chute to fall downwardly by gravity into the crushing zone 4 where it will be held by the support plate 28. When ram 3 moves in the next crushing stroke, the ram will move out of engagement with disk 34, enabling spring 36 to urge rod 30 inwardly to the obstructing position, where the rod will hold the can which had been previously released.

The chute 6 can be mounted for pivotal movement relative to the plate 1. In this regard, a pair of arms 40 extend outwardly in parallel relation from the lower end of chute 6 and the outer ends of the arms are pivoted by shaft 42 to cross member 44. Rod 30 is maintained in the position of FIG. 1 by a cotter pin notch (not shown) which is inserted within openings in the bracket 38. By removal of the cotter pin, chute 6 along with rod 30 can be pivoted relative to the plate 1 to thereby permit access to the lower end of chute 6.

As a salient feature of the invention, a coil spring 46 is mounted on the frame 1 for the purpose of guiding incoming cans 5 into the crushing zone 4, and facilitating release of crushed cans 5 in the crushing zone 4. Welded or otherwise joined to the top of anvil 2 is a cylinder 48 having a retaining knob 50. Coil spring 46 has one end 52 curled around knob 50 with the remainder of spring 46 coiled around cylinder 48 and terminating in an elongated finger 54 which projects downwardly into crushing zone 4. Finger 54 is provided with an adjustment mechanism 55 which changes the angular orientation of finger 54 in crushing zone 4. Adjustment mechanism 55 for finger 54 comprises a bracket 56 joined to the backside of cylinder 48 and provided with a screwthreaded shaft 58 having a stop member 60 on one end engageable with the finger 54 and an adjusting nut 62 on the other end which is tightened or loosened on shaft 58 as desired to move the stop member 60 backward or forward against finger 54.

As seen in the drawings, adjustment mechanism 55 is canted or tilted at an advantageous angle such that finger 54 defines a forward limit for cans 5 of various diameters being sequentially fed in the crushing zone 4. Whereas crushed cans 5 in the prior art apparatus sometimes hung-up on the ejector pins 23 and 25, finger 54 provides a biasing force which together with pins 23 and 25 enables the crushed can to be quickly stripped or released upon retraction of ram 3.

The ram 3 is shown in its fully retracted position in FIG. 1. In this retracted position, the rod stop 30 has been moved outwardly of the chute to permit the can 5 that was held by the rod in chute 6 to fall into the crushing zone 4. Spring finger 54 prevents the can from falling outwardly from the crushing zone 4. The support plate 28 is at a position where it will permit the previously crushed can to fall by gravity from the crushing zone but will support the uncrushed can being fed from the chute 6.

As the ram 3 moves forwardly in the crushing stroke, spring 36 will move the rod 30 inwardly to the supporting position in chute 6 and simultaneously the train of cans in the chute will fall downwardly where the lowermost can will be supported on the rod 30. Simultaneously, as the ram moves forwardly, the wedge plate 19 will engage the mid-point of the can 5, deforming the can and causing the can ends to be pivoted inwardly. Continued inward movement of the ram will move the wedge plate inwardly against the force of spring 22 and cause the can to be crushed between the ram 3 and the anvil 2.

As the ram moves outwardly and the return stroke support plate 28 moves along with the ram to a non-obstructing position to enable the crushed can to fall by gravity from the gravity from the crushing zone to a receptacle or other disposal site. If the crushed can should hang-up on the ram, it will be stripped from the ram by the ejector pins 23 and 25 as well as by the spring finger 54. The return stroke of the ram 3 simultaneously moves the rod 30 to the retracted position to enable the lowermost can to fall by gravity into the crushing zone.

As a safety feature of the invention, a one piece heavy duty metal guard 62 completely surrounds the mechanism and is positively secured such as by fasteners 64 to a base 66 underlying the frame 1. The metal guard 62 is provided with an upper window 68 on the chute 6 and lower window 70 aligned with the crushing zone 4 in order to monitor the position of cans 5 in both locations. In addition, lower window 70 prevents crushed material such as glass from being hurled outwardly towards an operator.

As seen best in FIG. 4, electrical power is supplied to motor 16 through an electrical cord 72 plugged into a standard wall outlet 74. Electrical cord 72 is connected to an electrical receptacle 76 welded to the side of frame 1. Plugged into electrical receptacle 76 is another electrical cord 78 which connects to an illuminated on-off switch 80 on the side of guard 62. Secured to the base 66 is a limit switch 82 cooperable with electrical receptacle 76 to normally provide electrical power to the apparatus when the container receptacle 29 is in place beneath the frame 1. However, if the container receptacle 29 is removed for any reason, the limit switch 82 will act with the electrical receptacle 76 to interrupt power to the device. As a further safeguard, electrical power to the motor 16 will be cut off, if one removes guard 62 due to the short length of electrical cord 78 and the capability of its plug 84 to separate from electrical receptacle 76. It should thus be appreciated that electrical power is normally controlled by the on-off switch 80 which lights up when power flows from outlet 74 and when guard 62 and container receptacle 29 are in their respective positions.

The invention provides a simple yet effective apparatus for crushing and releasing articles such as beverage cans or bottles and has particular use in restaurants, or bars, and the like, where the articles are fed through a vertical chute to the crushing apparatus.

The articles are crushed by a force operating transverse to the axis of the can, and the spring loaded wedge plate 19 initially deforms the can and aids in providing uniform compaction for the cans regardless of the axial length or diameter.

It should be appreciated that the invention provides a crushing and releasing device which enhances smooth operation and offers optimum continuous operating efficiency with the addition of adjustable coil spring 46 which markedly improves operation during the set-up, crushing and releasing phases of container compaction.

While the invention has been described with reference to a preferred embodiment, those skilled in the art will appreciate that certain substitutions, alterations and omissions may be made without departing from the spirit thereof. For example, in a simpler form of the invention, a hand crank (not shown) may be used in lieu of the motor 16 and together with gear 15, chain drive 14, sprocket 13 and wheel 12 to drive ram 3 inwardly and outwardly. Accordingly, the foregoing description is meant to be exemplary only, and should not be deemed limitative on the scope of the invention set forth with the following claims.

I claim:

1. An apparatus for crushing articles, comprising:

a frame, a fixed anvil mounted on the frame, a ram mounted for movement on the frame in a direction toward and away from said anvil to crush an article located in a crushing zone between said anvil and said ram, drive means for moving said ram in a direction toward and away from said anvil, chute means to support a stack of articles in end-to-end vertically superimposed relation, said stack including a lowermost article, retaining means disposed in said chute means and disposed to support the lowermost article in the stack, said retaining means movable between an article supporting position and a release position, means responsive to movement of the ram in a direction away from said anvil for moving said retaining means to the release position, and means projecting into said crushing zone for guiding articles into said crushing zone from said chute means.

2. The apparatus of claim 1 and including contacting means connected to said ram, and projecting outwardly from said ram toward said anvil for initially engaging and deforming said article prior to engagement of said article by said ram.

3. The apparatus of claim 2 and including resilient means for biasing said contacting means outwardly from said ram, said contacting means being moved inwardly against the force of said resilient means as the article is crushed by said ram.

4. The apparatus of claim 3, wherein said contacting means is disposed transverse to the axis of said article and is disposed to engage said article between the ends thereof.

5. The apparatus of claim 4, wherein said contacting means comprises a flat, horizontal plate.

6. The apparatus of claim 1 and including stripping means disposed in the crushing zone and disposed to be engaged by a crushed article to prevent said article from adhering to said ram as said ram moves in the direction away from said anvil.

7. The apparatus of claim 6, wherein said stripping means comprises a pair of pins operably connected to the frame and mounted for movement in an opening in said ram, each of said pins having an end disposed in said crushing zone.

8. The apparatus of claim 1, wherein said means responsive to movement of said ram in a direction away from said anvil for moving said article supporting means comprises a plate connected to said ram and movable between an obstructing position where said plate is located beneath said crushing zone and a non-obstructing position.

9. The apparatus of claim 1 and including means for mounting said chute means for pivotal movement relative to said frame.

10. The apparatus of claim 1, including guard means completely surrounding said frame, said anvil, said ram, said driver means, said chute means, said retaining means, said means responsive to movement of the ram in a direction away from said anvil and said means projecting into said crushing zone.

11. An apparatus for crushing an article having a generally cylindrical sidewall and a pair of opposed inwalls, comprising:

a supporting frame, a fixed anvil mounted on the frame, a ram spaced from the anvil to provide a crushing zone therebetween and movable in a direction toward and away from said anvil to crush an article in the crushing zone, a chute to contain an article and having a lower end communicating with said crushing zone, feeding means for feeding an article from the chute to the crushing zone, drive means for moving the ram in a direction toward said anvil to crush the article in the crushing zone and for moving the ram in a direction away from said anvil, contacting means connected to the ram and projecting outwardly from the ram toward said anvil, said contacting means disposed to initially engage the sidewall of the article prior to engagement of said article by said ram, resilient means for biasing said contacting means outwardly from said ram in a direction toward said anvil; said contacting means being moved inwardly against the force of said resilient means as said article is crushed by said ram, stripping means disposed in the crushing zone and disposed to be engaged by a crushed article to prevent said article from adhering to said ram as the ram moves in a direction away from said anvil, said stripping means being mounted in fixed relation to said supporting frame and being mounted for movement in an opening in said ram, and biasing means mounted on said frame and cooperable with said stripping means for facilitating release of said crushed article as said ram moves in a direction away from said anvil.

12. The apparatus of claim 11, wherein said biasing means comprises a compression spring having a finger disposed to engage said article.

13. The apparatus of claim 12, wherein said compression spring includes an adjustment mechanism for changing the angular orientation of said finger in said crushing zone.

14. An apparatus for crushing articles, comprising:

a frame, a fixed anvil mounted on the frame, a ram mounted for movement on the frame in a direction toward and away from said anvil to crush an article located in a crushing zone between said anvil and said ram, a container receptacle disposed beneath said crushing zone for receiving the crushed articles;

drive means for moving said ram in a direction toward and away from said anvil, electrical power means for supplying electrical power to said drive means;

chute means to support a stack of articles in end-to-end relation, said stack including a lowermost article, retaining means disposed in said chute means and disposed to support the lowermost article in the stack, said retaining means movable between an article supporting position and a release position, means responsive to movement of the ram in a direction away from said anvil for moving said retaining means to the release position, article support means disposed at the lower end of said crushing zone and mounted for movement between an article supporting position and a release position, means responsive to movement of said ram in a direction away from said anvil for moving said article supporting means to the release position to thereby enable a crushed article to be discharged from said crushing zone, guard means fastened to said frame and surrounding said frame, said anvil, said ram, said drive means, said chute means, said retaining means, said article support means, and said means responsive to movement of said ram in a direction away from said anvil; and disconnect means for automatically cutting off electrical power to said drive means in the event said container receptacle is moved from beneath said crushing zone and said guard means is removed from said frame.

15. The apparatus of claim 14, wherein said article comprises a can having a longitudinal axis, said article support means is constructed to support a can with the axis of the can disposed normal to the direction of movement of the ram.

16. An apparatus for crushing articles, comprising:

a frame, a fixed anvil mounted on the frame, a ram mounted for movement on the frame in a direction toward and away from said anvil to crush an article located in a crushing zone between said anvil and said ram, drive means for moving said ram in a direction toward and away from said anvil, chute means to support a stack of articles in end-to-end relation, said stack including a lowermost article, retaining means disposed in said chute means and disposed to support the lowermost article in the stack, said retaining means movable between said article supporting position and a release position, means responsive to movement of the ram in a direction away from said anvil for moving said retaining means to the release position, wedge means connected to the ram and projecting outwardly from the ram toward said anvil for initially engaging and deforming said article prior to engagement of said article by said ram, resilient means for biasing said wedge means outwardly from said ram, said wedge means being moved inwardly against the force of said resilient means as said article is crushed by said ram, and adjustable biasing means mounted on said frame and projecting into said crushing zone for guiding articles into said crushing zone from said chute means, and for facilitating release of said crushed articles as said ram moves in a direction away from said anvil.

* * * * *